US006561525B1

(12) United States Patent
Chou

(10) Patent No.: US 6,561,525 B1
(45) Date of Patent: May 13, 2003

(54) IN-LINE SKATING DEVICE OF ROLLER SKATE

(76) Inventor: Tien-Chiu Chou, 6F, No. 185, Sec. 1, Taichung Kang Road, Taichung City (TW)

( * ) Notice: Subject to any disclaimer, the term of this patent is extended or adjusted under 35 U.S.C. 154(b) by 0 days.

(21) Appl. No.: 09/592,112

(22) Filed: Jun. 12, 2000

(51) Int. Cl.[7] ..... A63C 17/14; A63C 17/04

(52) U.S. Cl. ..... 280/11.221; 280/11.27; 280/11.215; 280/11.231

(58) Field of Search ..... 280/11.204, 11.211, 280/11.215, 11.221, 11.223, 11.27, 11.28, 11.231, 11.225, 11.217

(56) References Cited

U.S. PATENT DOCUMENTS 5,135,244 A * 8/1992 Allison ..... 280/11.28
5,342,071 A * 8/1994 Soo ..... 280/11.22
5,582,418 A * 12/1996 Closser ..... 280/11.22
5,639,104 A * 6/1997 Haldemann ..... 280/11.22
5,690,344 A * 11/1997 Chen ..... 280/11.28
5,904,359 A * 5/1999 Caeran et al. ..... 280/11.15
5,927,728 A * 7/1999 Gignoux et al. ..... 280/11.2
5,957,470 A * 9/1999 Powell ..... 280/11.22
5,979,916 A * 11/1999 Gatel et al. ..... 280/11.22
6,045,142 A * 4/2000 Andrich ..... 280/11.22
6,120,040 A * 9/2000 Svensson et al. ..... 280/11.224
6,158,748 A * 12/2000 Caeran ..... 280/11.22
6,196,557 B1 * 3/2001 Gerard ..... 280/11.28
6,375,198 B1 * 4/2002 Caeran et al. ..... 280/11.221

* cited by examiner

*Primary Examiner*—Frank Vanaman
*Assistant Examiner*—Jeffrey Restifo
(74) *Attorney, Agent, or Firm*—Browdy and Neimark, P.L.L.C.

(57) ABSTRACT

An in-line skating device of a roller skate has a base which is fastened to the sole of a boot of the roller skate is fastened pivotally with a wheel carrier. The wheel carrier is provided with a plurality of wheels pivoted thereto in sequence. The carrier is formed of at least two pairs of carrying plates. Two carrying plates of each pair are connected in a parallel manner and are pivoted in the longitudinal direction. The wheels are respectively pivoted between the two carrying plates. The pivoting point of two adjoining carrying plates is located on the axle of one of the wheels. When the base turns in relation to the carrier, the carrying plates of one pair displace in relation to the carrying plates of other pair, thereby enabling the wheels pivoted to the carrying plates of one of the pairs to remain in contact with the ground surface so as to enable the roller skate to be started swiftly at a fast pace.

9 Claims, 8 Drawing Sheets

IN-LINE SKATING DEVICE OF ROLLER SKATE

FIELD OF THE INVENTION

The present invention relates generally to a roller skate, and more particularly to an in-line skating device enabling the roller skate to start swiftly at a fast pace and having means for braking the roller skate in motion in a smooth and gentle manner.

BACKGROUND OF THE INVENTION

The conventional in-line skating device of the roller skate comprises a plurality of wheels, which are uniformly pivoted to a sole plate. The device is defective in design in that it prevents the roller skate from being started promptly or suddenly at a fast pace in view of the fact that some wheels can not be maneuvered to remain in contact with the ground while other wheels have left the ground. As a result, a roller skater must resort to all wheels or the front wheel to start the roller skate. It is conceivably difficult to start the roller skate swiftly by means of all wheels because of a considerable friction force that has to be overcome. On the other hand, it is also difficult to start the roller skate rapidly by the front wheel which does not afford a sufficient impetus.

An improved in-line skating device is disclosed by the WO 96136408 patent and is used to fasten pivotally the base of the boot with the carrier of the wheels. The base is provided with a brake shoe, which is put into action at the time when the base turns in relation to the carrier. The device is defective in design in that the braking action is apt to jam the wheels in motion.

SUMMARY OF THE INVENTION

The primary objective of the present invention is to provide a roller skate with an in-line skating device which is free from the deficiencies of the prior art devices described above.

The device of the present invention comprises a base and a wheel carrier fastened pivotally with the base. The base is fastened to the sole of a boot. The wheel carrier is formed of two pairs of carrying plates. Two carrying plates of each pair are connected with each other in a parallel fashion. Each wheel is pivoted between the two carrying plates. The carrying plates of each pair are pivoted together in sequence lengthwise. The pivoting point of two adjoining pairs of the carrying plates is located on the axle of one of the wheels. When the base turns in relation to the wheel carrier, one pair of the carrying plates displace in relation to other pair of the carrying plates, thereby enabling the wheel which is pivoted to one pair of the carrying plates to make contact with the ground.

The base of the device of the present invention is provided at one end with a braking mechanism comprising an arresting wheel which is capable of arresting the corresponding wheel at such time when the base turns in relation to the wheel carrier. As a result, the roller skate in a gliding motion can be slowed down or stopped stably and gently by the braking mechanism.

DETAILED DESCRIPTION OF THE INVENTION

Figure 1:
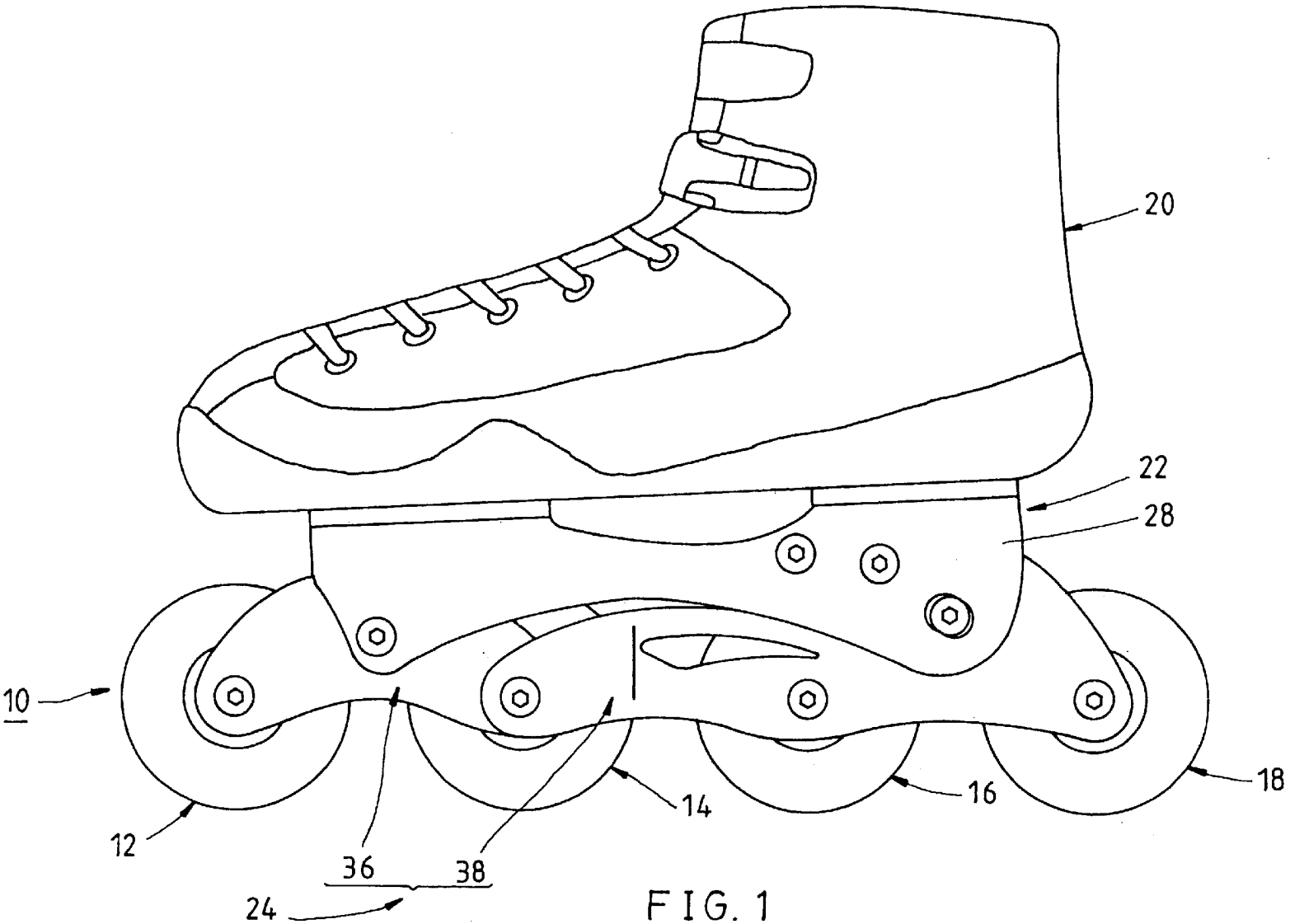
FIG. 1 shows a schematic view of an in-line roller skate of a first preferred embodiment of the present invention.

As shown in FIG. 1, an in-line skating device 10 of the first preferred embodiment comprises four wheels 12, 14, 16, and 18, which are linearly arranged such that the first wheel 12 is located at the toe end, and that the fourth wheel 18 is located at the heel end. The device 10 is fastened to the sole of a boot 20 by a plurality of rivets (not shown in the drawing).

Figure 2:
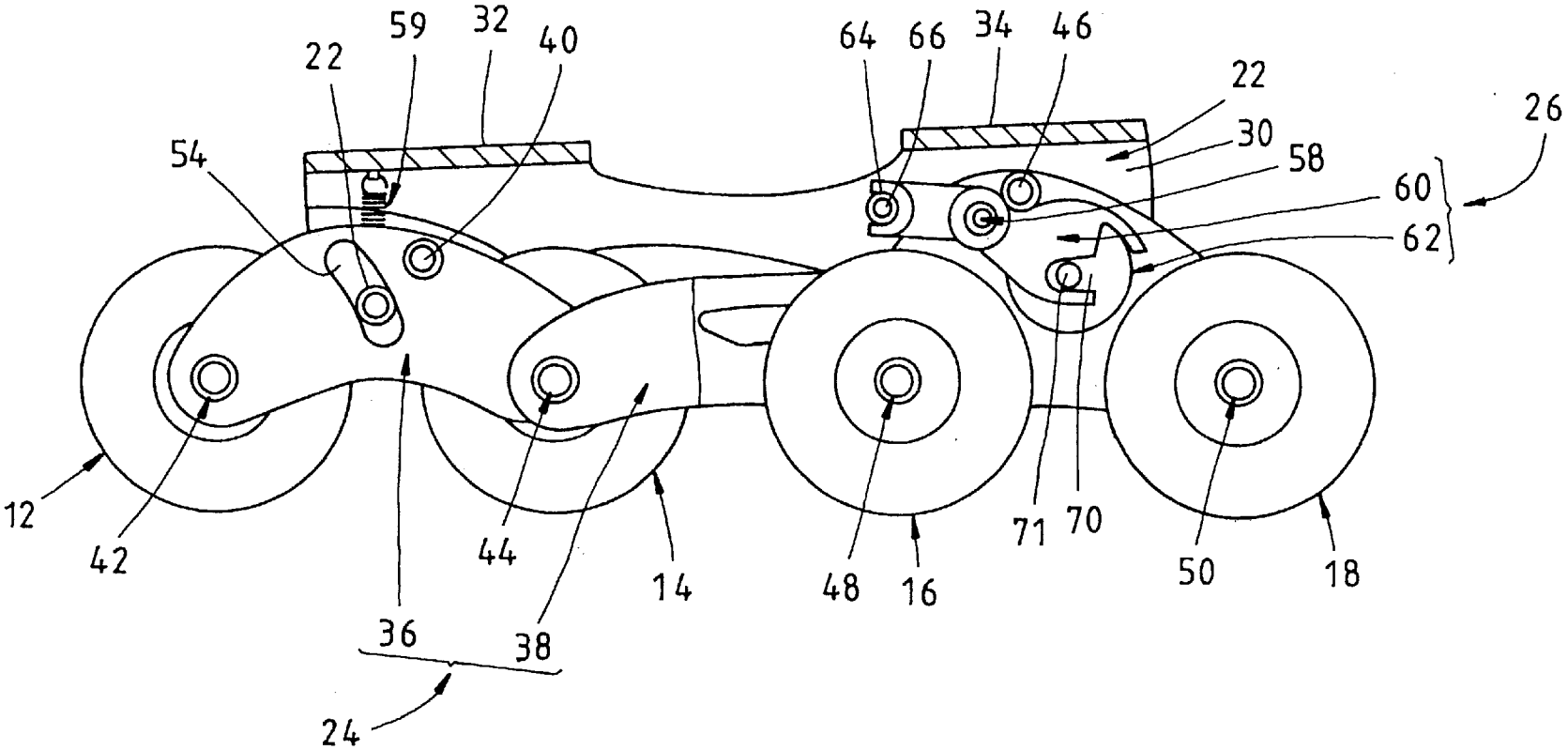
FIG. 2 shows a partial schematic side view of the in-line roller skate of the first preferred embodiment of the present invention.
Figure 4:
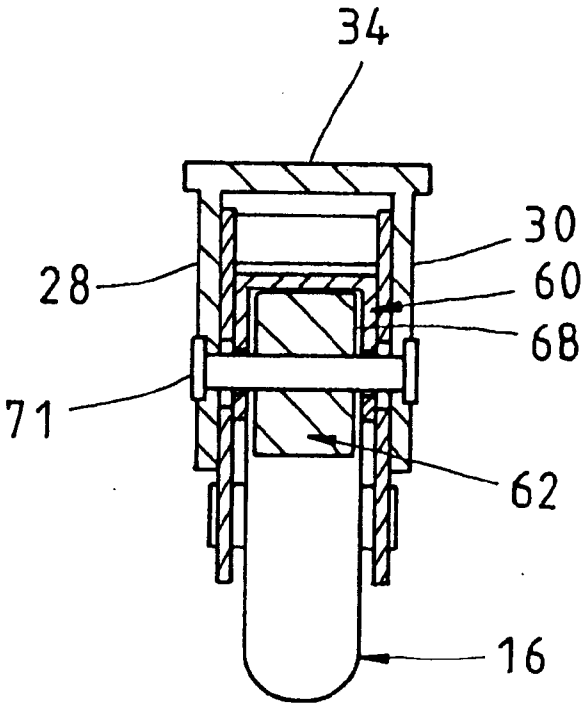
FIG. 4 shows a sectional view of a portion indicated by the direction of a line 4—4 as shown in FIG. 1.
Figure 3:
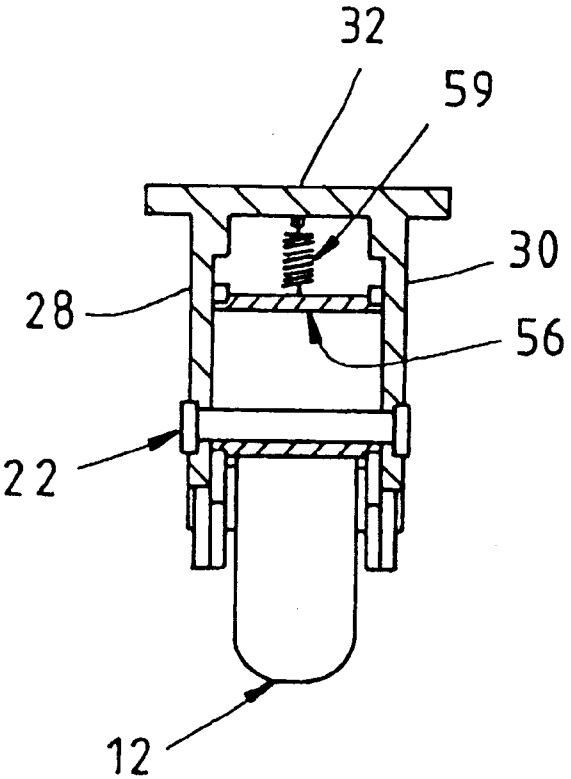
FIG. 3 shows a sectional view of a portion indicated by the direction of a line 3—3 as shown in FIG. 1.

As shown in FIGS. 2 and 3, the device 10 of the first preferred embodiment of the present invention comprises a base 22 by which the device 10 is fastened to the sole of the boot 20, a wheel carrier 24 for carrying the four wheels 12, 14, 16 and 18, and a braking mechanism 26.

The base 11 has two parallel long side plates 28 and 30, which are connected with each other by a front end plate 32 and a rear end plate 34. The base 22 is fastened with the boot 20 such that the front end plate 32 is fastened with the sole of the boot 20, and that the rear end plate 34 is fastened with the heel portion of the boot 20.

The wheel carrier 24 is formed of a pair of front carrying plates 36 and a pair of rear carrying plates 38. The two front carrying plates 36 are fastened together by a fastening pin 40 in a parallel manner. Two shaft pins 42, 44 are provided for mounting rotatably the wheels 12 and 14 such that the shaft pins 42 and 44 are put through the pivoting points of the two side ends of the front carrying plates 36 and the axial holes of the wheels 12 and 14. The rear carrying plates 38 are fastened in a parallel manner by a fastening pin 46. The rear carrying plates 38 are provided with three pivoting points which are equidistantly arranged. The front pivoting point extends to the rear end of the front carrying plate 36, whereas the rear pivoting points overlap and are penetrated by the shaft pin 44. The wheels 16 and 18 are rotatably mounted on two shaft pins 48 and 50, which are put through the rear carrying plates 38, the rear pivoting points, and the axial holes of the wheels 16 and 18.

The base 22 is provided at the front end with a slide rod 52 fastened therewith such that the slide rod 52 is received in an arcuate hole 54 of the front carrying plate 36, thereby enabling the front ends of the base 22 and the carrier 24 to displace along the arcuate hole 54 in relation to each other. The first preferred embodiment of the present invention is provided with an arcuate jacket 56 of a plastic material, which is disposed between the two front carrying plates 36 such that two openings thereof are corresponding in location to the arcuate holes 54, and that the slide rod 52 is fitted thereinto to move along the arcuate hole 56. The rear end of the base 22 is pivoted with the rear carrying plates, 38 by a fastening pin 58. The rear end of the base 22 is capable of swiveling on the fastening pin 58 serving as a pivot. The front end plate 32 of the base and the top of the jacket 56 are provided therebetween a coil spring 59 for keeping the wheels 12 and 14 at the position as shown in FIG. 2 at the time when the wheels 12 and 14 are not exerted on by an external force.

The braking mechanism 26 comprises a support arm 60 and an arresting wheel 62. The support arm 60 is made of a plastic material by molding and is provided at the front end with a recessed mouth 64 for disposing an insertion pin 66 which is fastened between the two side plates of the base. The center of the arm body is penetrated by the fastening pin 58. The arm 60 is provided at the rear end with a receiving chamber 68 for receiving the arresting wheel 62. The receiving chamber 68 is provided in the two side walls with a recess 70 for receiving an axle 71 of the arresting wheel 62. The arresting wheel 62 is fastened with the support arm 60 such that the arresting wheel 62 is located at a predetermined level between the wheels 16 and 18.

When the in-line skating device 10 is in the state as shown in FIG. 2, all wheels are in contact with the ground. In the meantime, the braking mechanism 26 is not in contact with any one of the wheels. Under such a circumstance, the device 10 works like the conventional in-line skating device. The device 10 of the present invention has two functional advantages over the prior art counterpart. In the first place, the device 10 of the present invention enables the roller skate to start at a fast pace. Secondly, the device 10 affords the roller skate a smooth brake action.

Figure 5:
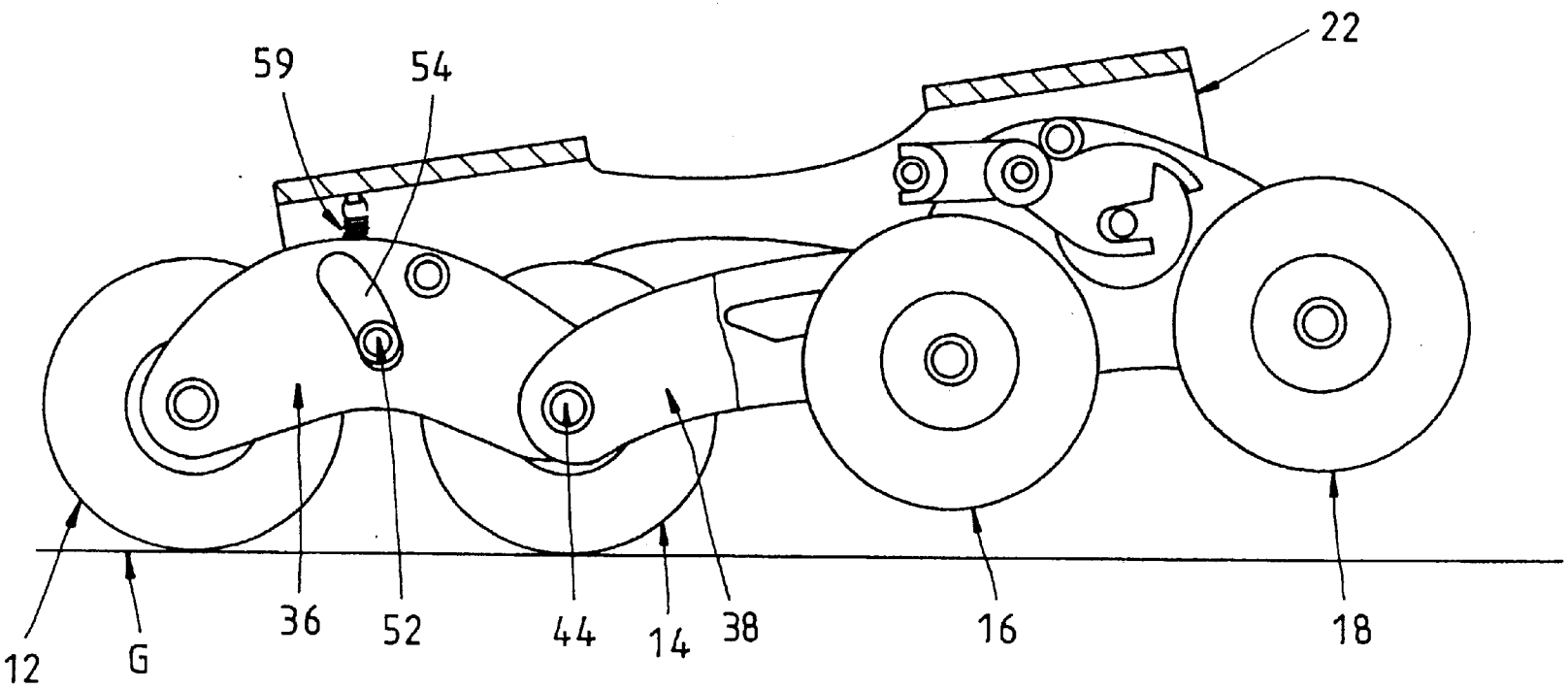
FIG. 5 shows a schematic view of two wheels of the first preferred embodiment of the present invention in motion.

As illustrated in FIG. 5, when a roller skater is ready to start gliding on the ground, the roller skater may use his or her sole to press the device 10 with an appropriate force so as to cause the top end of the base 22 to move along the slide rod 52 to the bottom end of the arcuate hole 54. In the meantime, the rear carrying plate 38 of the wheel carrier 24 turns upward on the shaft pin 44 in relation to the front carrying plate 36. With the exception of the front carrying plate 36, the remainder of the device 10 is slightly tilted forward such that only the first wheel 12 and the second wheel 14 are in contact with a ground surface "G" at the time when the roller skater begins gliding on the ground surface "G". In light of only two wheels 12 and 14 being in contact with the ground surface, the device 10 of the present invention is encountered with a lesser frictional force, thereby enabling the roller skater to start swiftly at a fast pace. In the midst of gliding at a desired speed with two wheels 12 and 14, the roller skater pulls back his or her heel portion to cause the compressed spring 59 to return to its original form, thereby making the recovery spring force available to the front carrying plate 36 to take the two wheels 12 and 14 back to the state as shown in FIG. 2. As a result, the roller skater glides on the four wheels 12, 14, 16, and 18.

Figure 6:
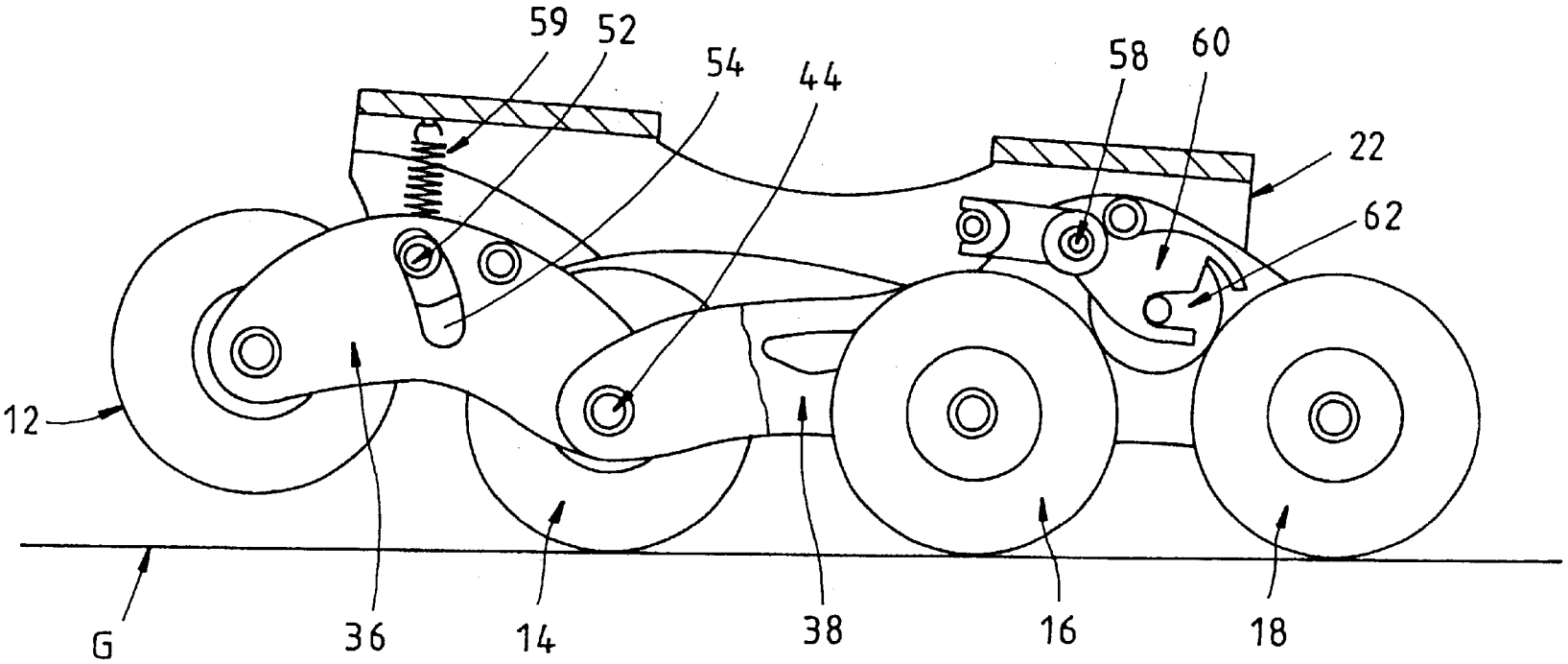
FIG. 6 shows a schematic view of the braking mechanism of the first preferred embodiment of the present invention in action.

As illustrated in FIG. 6, the roller skate in motion is slowed down or stopped by pressing the device 10 with the roller skater's heel so as to cause the heel end of the base 22 to swivel downward on the fastening pin 58 in relation to the wheel carrier 24. In the meantime, the toe end of the base 22 travels along the arcuate hole 54 to arrive at the upper end of the arcuate hole 54, whereas the front end of the front carrying plate 36 carries the first wheel 12 to swivel upward on the shaft pin 44. As a result, the arresting wheel 62 is forced to move from the position as shown in FIG. 2 to the position as shown in FIG. 6. The arresting wheel 62 is thus forced against the third wheel 16 and the fourth wheel 18. In other words, the braking action is brought about with ease by using the heel of the roller skater to put an appropriate pressure on the device 10 of the present invention, without having to concentrate the body weight of the roller skate on the heel end of the base 22. The roller skater may resume the gliding after interruption by keeping the feet in the horizontal position, thereby resulting in the disengagement of the arresting wheel 62 with the third wheel 16 and the fourth wheel 18. As a result, all four wheels 12, 14, 16, and 18 come in contact with the ground surface. In other words, the base 22 turns on the fastening pin 58 to return to the position as shown in FIG. 2 from the position as shown in FIG. 6.

Figure 7:
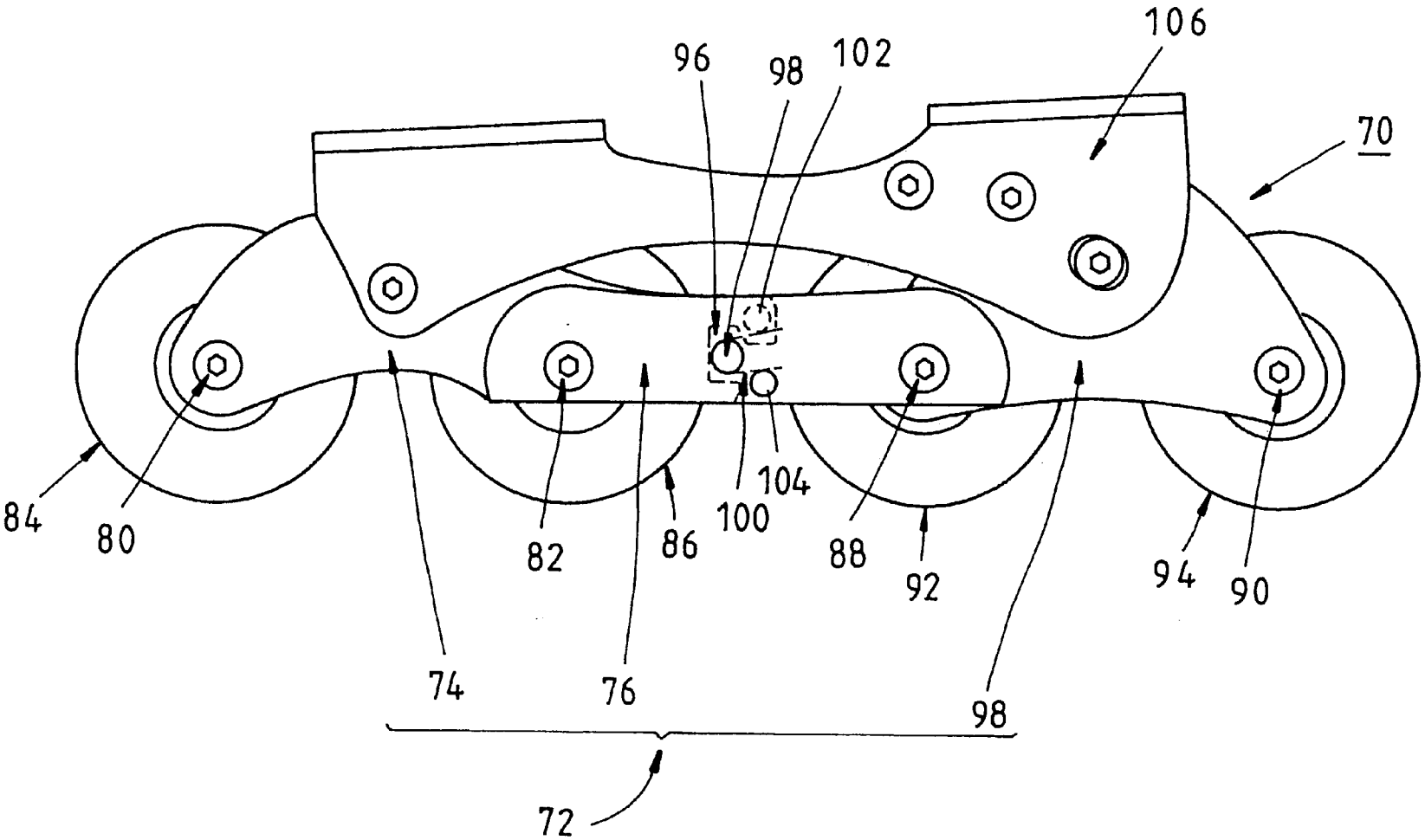
FIG. 7 shows a side schematic view of a second preferred embodiment of the present invention.
Figure 8:
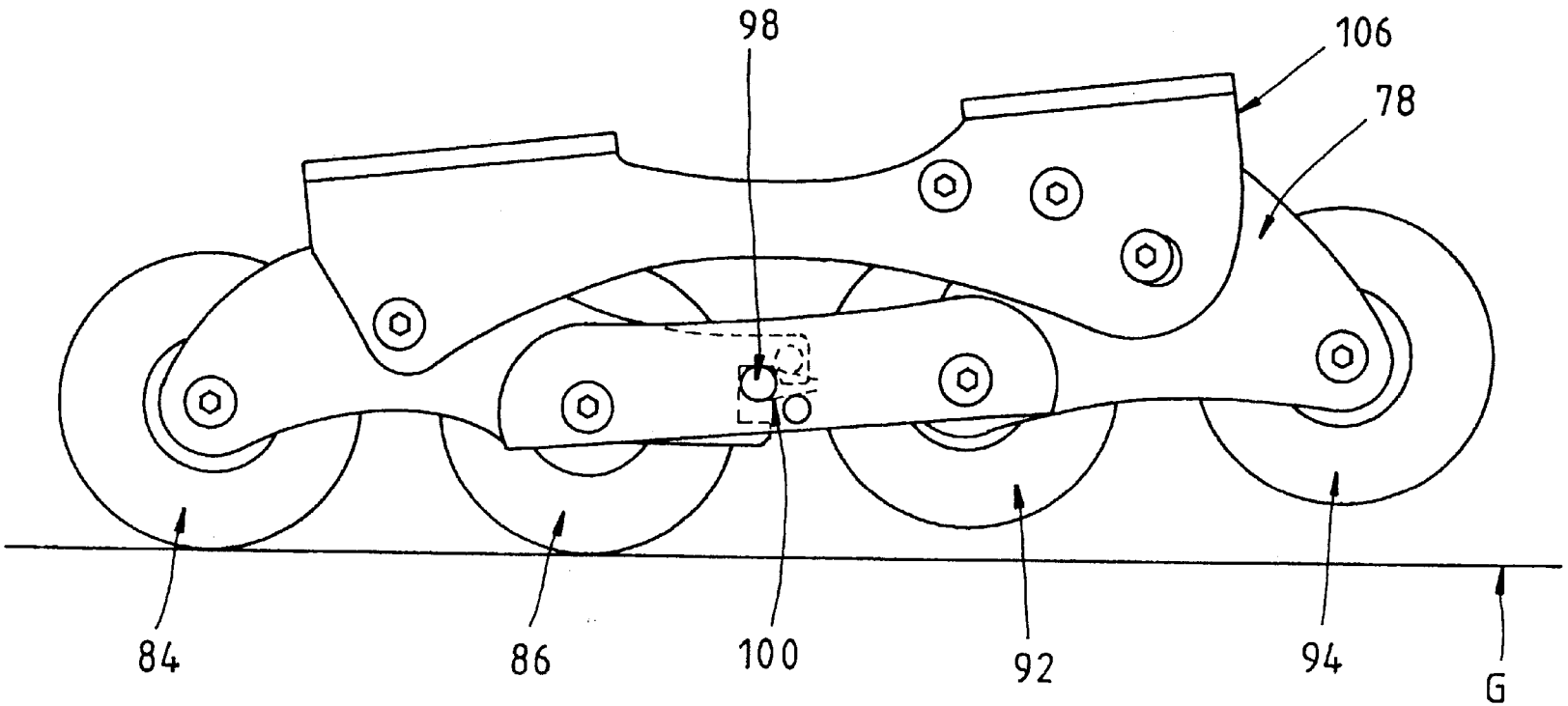
FIG. 8 shows a schematic view of two wheels of the second preferred embodiment of the present invention in motion.
Figure 9:
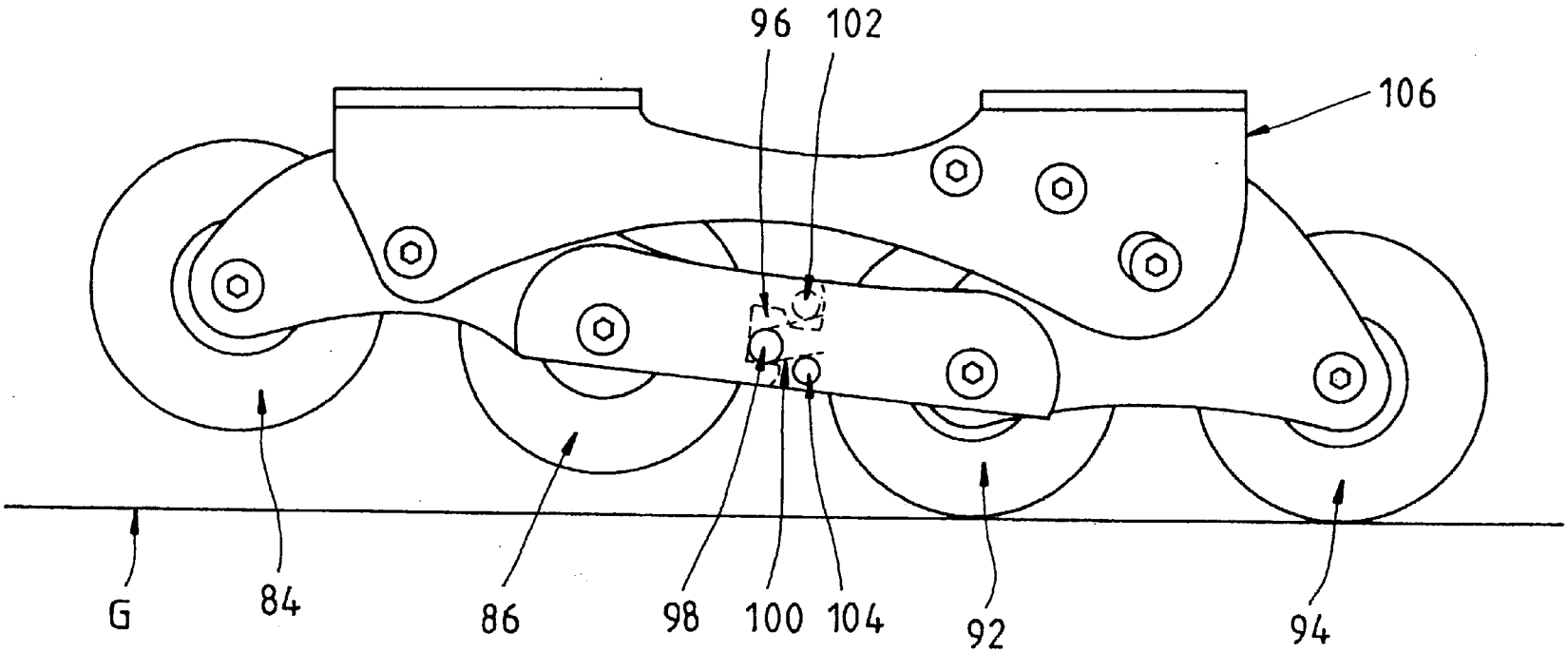
FIG. 9 shows a schematic view of the braking mechanism of the second preferred embodiment of the present invention in action.

As shown in FIGS. 7–9, an in-line skating device 70 of the second preferred embodiment of the present invention is basically similar in construction to the in-line skating device 10 described above, with the difference being that the former comprises a wheel carrier 72 which is formed of three pairs of the carrying plates 74, 76, and 78. The front carrying plates 74 are provided with two shaft pins 80 and 82 for pivoting two wheels 84 and 86. The rear carrying plates 78 are provided with two shaft pins 88 and 90 for pivoting two wheels 92 and 94. The middle carrying plates 76 are fastened pivotally at both front and rear ends with the rear ends of the front carrying plates 74 and the front ends of the rear carrying plates 78 by the shaft pins 82 and 88. The front carrying plates 74 are provided at the rear ends with a position confining slot 96 having an opening. A position confining pillar 98 is put through the position confining slot 96 to fasten with the center of the middle carrying plate 76 such that the position confining pillar 98 is fitted into a torsion spring 100 which urges at one end thereof the fastening pillar 102 of the rear end of the front carrying plate 74, and at other end thereof the fastening pillar 104 of the middle carrying plate 76.

The in-line skating device 70 is started by pressing with the foot sole the device 70, so as to cause the toe end of the base 106 to displace downward. In the meantime, the two wheels 92 and 94 of the rear carrying plates 78 are lifted from the ground surface "G". As a result, only two wheels 84 and 86 are in contact with the ground surface, as shown in FIG. 8. As the roller skater glides at a desired speed, the other two wheels 92 and 94 can be caused to come in contact with the ground surface by pulling back his or her soles in view of the fact that each carrying plate of the wheel carrier 72 is forced by the recovery force of the torsion spring 100 to return to its original state. The roller skate in motion can be slowed down or stopped by pressing with the foot heel the in-line skating device 70, thereby causing the wheels 84 and 86 to be lifted by the action of the connection rods of the carrying plates, as shown in FIG. 9. The roller skater may resume the gliding after interruption by keeping his or her feet in the horizontal position. The base 106 returns from the position as shown in FIG. 9 to the position as shown in FIG. 7. All four wheels are no longer arrested and are in contact with the ground surface.

What is claimed is:

1. An in-line skating device of a roller skate, said device comprising:

a base fastened to the sole of a boot of the roller skate;

a wheel carrier fastened pivotally with said base;

a plurality of wheels pivoted to said wheel carrier;

wherein said wheel carrier comprises at least two pairs of carrying plates, with two carrying plates of each pair of said two pairs being connected with each other in a parallel manner, said wheels being pivoted respectively between two carrying plates, said carrying plates being arranged in sequence such that adjoining ends of said carrying plates are pivoted together at an axle of one of said wheels so as to enable said carrier to turn in relation to said base, said pairs of said carrying plates being able to displace in relation to each other, thereby leaving a predetermined number of said wheels to be in contact with the ground surface.

2. The device as defined in claim 1 further comprising a braking mechanism which is fastened with said base for arresting a predetermined number of said wheels at such time when said base turns in relation to said wheel carrier.

3. The device as defined in claim 2, wherein:

said base has a heel end;

said wheel carrier is formed of one pair of rear carrying plates to which at least two of said wheels are pivoted; and said braking mechanism comprises a support arm and an arresting wheel, said support arm being fastened to said heel end of said base, said arresting wheel being pivoted to said support arm such that said arresting wheel is disposed at a predetermined level between two of said wheels pivoted to said rear carrying plates, and that said arresting wheel displaces downward to arrest said two wheels at such time when said heel end of said base swivels downwards.

4.The device as defined in claim 1, wherein said wheel carrier is formed of one pair of front carrying plates and one pair of rear carrying plates, said front carrying plates being provided in two longitudinal ends with a pivoting point for pivoting one of said wheels, said rear carrying plates being provided in two longitudinal ends with a pivoting point, and in a center with a pivoting point, said pivoting point of one of said longitudinal ends being pivoted with said pivoting point of one end of said front carrying plate, other two pivoting points of said rear carrying plates being pivoted with one of said wheels.

5. The device as defined in claim 4, wherein said base has a toe end and a heel end, with said heel end being rotatably fastened with rear carrying plates, said toe end being fastened with said front carrying plates such that said toe end displaces in a range of a predetermined radian whereby said rear carrying plates swivel in relation to said front carrying plates so as to lift said wheels pivoted thereto at such time when said toe end of said base is exerted on by an external force.

6. The device as defined in claim 5, wherein said front carrying plates are provided between said two pivoting points thereof with an arcuate hole; wherein said toe end of said base is fastened with a slide rod whereby said slide rod is slidably received in said arcuate hole, thereby enabling said toe end to slide along the track of said arcuate hole at the time when said heel end of said base turns.

7. The device as defined in claim 6 further comprising an arcuate jacket having two openings, said jacket being disposed between said first pair of carrying plates such that said two openings are corresponding to said arcuate hole for said slide rod to be fitted thereinto and to move along the track of said arcuate hole.

8. The device as defined in claim 7 further comprising a coil spring urging at one end thereof said toe end of said base, and at other end thereof said jacket, thereby enabling said two wheels of said front carrying plates to remain in contact with the ground surface at the time when said two wheels are not exerted on by an external force.

9. The device as defined in claim 1 wherein each pair of carrying plates has at least one of said wheels pivoted thereto.

* * * * *